US010306357B2

(12) United States Patent
Isotalo et al.

(10) Patent No.: US 10,306,357 B2
(45) Date of Patent: May 28, 2019

(54) LOUDSPEAKER SYSTEM WITH DIRECTIONAL OUTPUT CHARACTER

(71) Applicant: Aura Audio Oy, Lieto (FI)

(72) Inventors: Mika Isotalo, Turku (FI); Jan Thome, Marttila (FI)

(73) Assignee: AURA AUDIO OY, Lieto (FI)

( * ) Notice: Subject to any disclaimer, the term of this patent is extended or adjusted under 35 U.S.C. 154(b) by 18 days.

(21) Appl. No.: 15/479,098

(22) Filed: Apr. 4, 2017

(65) Prior Publication Data

US 2017/0289675 A1 Oct. 5, 2017

(30) Foreign Application Priority Data

Apr. 4, 2016 (FI) ..... 20160080

(51) Int. Cl.

| | |
|---|---|
| ***H04R 1/32*** | (2006.01) |
| ***H04R 1/28*** | (2006.01) |
| ***H04R 1/34*** | (2006.01) |
| ***H04R 3/12*** | (2006.01) |
| ***H04R 1/30*** | (2006.01) |
| *H04R 1/22* | (2006.01) |

(52) U.S. Cl.

CPC ..... *H04R 1/323* (2013.01); *H04R 1/2842* (2013.01); *H04R 1/2849* (2013.01); *H04R 1/30* (2013.01); *H04R 1/345* (2013.01); *H04R 3/12* (2013.01); *H04R 1/227* (2013.01); *H04R 1/2857* (2013.01)

(58) Field of Classification Search

CPC ..... H04R 1/323; H04R 1/403

See application file for complete search history.

(56) References Cited

U.S. PATENT DOCUMENTS

| | | | | |
|---|---|---|---|---|
| 3,131,783 | A * | 5/1964 | Mares | H04R 1/2857 181/145 |
| 3,816,672 | A | 6/1974 | Gefvert | |
| 4,348,549 | A | 9/1982 | Berlant | |
| 5,073,945 | A * | 12/1991 | Kageyama | H04R 1/227 381/184 |
| 8,842,866 | B2 * | 9/2014 | Christner | H04R 1/323 381/182 |
| 2005/0178611 | A1 | 8/2005 | Noselli et al. | |
| 2008/0137894 | A1 | 6/2008 | Christner | |
| 2017/0094404 | A1 * | 3/2017 | Ekedahl | H04R 1/30 |

FOREIGN PATENT DOCUMENTS

EP 0500294 A2 * 2/1992

OTHER PUBLICATIONS

Office Action dated Nov. 9, 2016 in FI Patent Application No. 20160080.

* cited by examiner

*Primary Examiner* — Brian Ensey
*Assistant Examiner* — Ryan Robinson
(74) *Attorney, Agent, or Firm* — Kubovcik & Kubovcik

(57) ABSTRACT

A loudspeaker system (50) has a front loudspeaker enclosure (10) having at least one front loudspeaker (20) and a rear loudspeaker enclosure (30) having at least one second loudspeaker (40). The front loudspeaker enclosure (10) is in the form of a horn-loaded enclosure. The rear loudspeaker enclosure (30) is in the form of a vented high-pass enclosure.

11 Claims, 3 Drawing Sheets

LOUDSPEAKER SYSTEM WITH DIRECTIONAL OUTPUT CHARACTER

Figure 1:
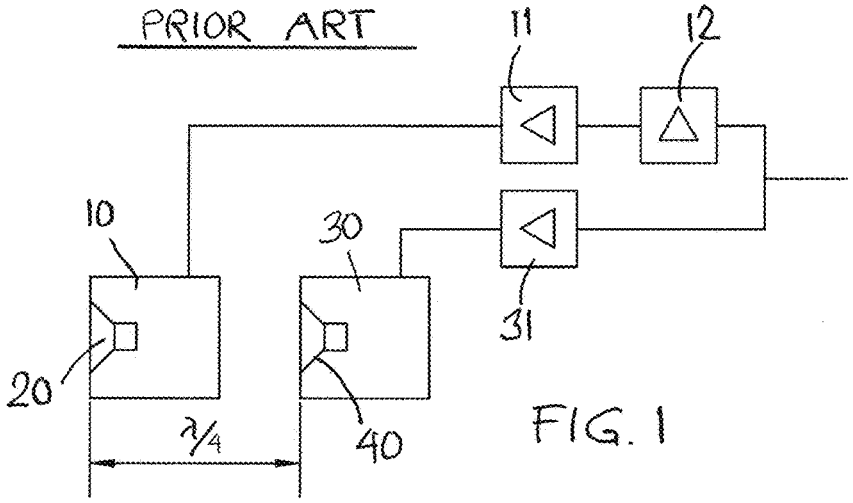

The subject of the invention is a directional loudspeaker system for low frequency sound.

Directional character and noise cancellation are of increasing importance in open-air events and are also known to help produce sound more accurately in reverberant environments such as concert halls and sport arenas.

The invention relates to bass loudspeaker systems with rearward sound suppression. The key feature compared to the prior art is to obtain a considerably higher acoustic output in front of the speaker system compared to previous designs. Bass loudspeaker systems are described in prior art publications: U.S. Pat. No. 8,842,866, US20050178611, U.S. Pat. Nos. 5,588,065, 5,073,945, US2008137894A1, U.S. Pat. Nos. 4,348,549A and 3,816,672A.

Single enclosure bass loudspeaker systems have typically very low directivity character because of the large wavelength which is to be radiated to produce sound in the bass region, in frequencies between 30 Hz to 100 Hz, which equals wavelengths from 10 m to 3 m. To have a directional character comparable to the said wavelengths the enclosures and particularly the radiating surfaces need to be around the same size which would make them hard or impossible to carry or install in most environments such as indoors or limited space outdoor facilities.

There are several approaches already known which can be used to improve the directivity of low frequency sound sources. One option is to use an open back enclosure, i.e., a so called dipole arrangement, in which sound waves in the sides of the enclosure are canceled due to out of phase summing of sound radiating from front and back of a single transducer.

A second option is to have two separate sound sources, in which case one sound source usually radiates to the listening direction and other sound source to the opposite direction. The sound source radiating to the opposite direction is tuned to have the same radiation character, i.e., frequency and phase response, compared to the one radiating in front. When inverting the polarity of the sound radiating to the opposite direction one can cancel the sound arriving from the rear radiating source thus creating directional radiating character. This is known to be done with either two amplifier channels with different drive signals or by tuning the opposite radiating sound source with an additional low-pass filter.

A vented high-pass front enclosure and a sixth-order enclosure for the opposite radiating enclosure can be used.

In all cases these known ways to create directional radiating character suffer from low efficiency due to not using the two sound sources to increase the sound pressure in front but instead to decrease the sound radiating to the opposite direction.

It is known to use two or three sound sources in a row and delay the front sound source or front sound sources to match the propagation time difference due to distance. This arrangement is known to cancel the sound waves with wave lengths of four times the enclosure distance when observed behind the row of speakers, opposite the direction of radiation pattern. In such a configuration any type of bass enclosure can be used, for example, high efficiency horn-loaded speakers.

The purpose of the invention is to obtain a higher acoustic output in front of the speaker system by increasing the sound pressure in front of the speaker system and to increase the directional output character of the loudspeaker system.

The invention is based on an object of providing a loudspeaker system which has a high efficiency loading in a front radiating sound source with an internal propagation time difference to compensate the time difference of the sound waves radiated from the opposite direction radiating sound source arriving to the front.

For the invention to work properly the loudspeaker system is designed so that the front radiating sound source provided by a front loudspeaker and a horn that has a relatively same sound wave path length from the front loudspeaker to the mouth of the horn as compared to the sound wave path length from the rear loudspeaker of the rear radiating sound source to the mouth of the horn of the front loudspeaker. The loudspeaker system can also have two or more front radiating sources and/or two or more rear radiating sources. In these cases at least one front radiating source has a relatively same sound wave path length as at least one sound wave path length from the rear loudspeaker to the mouth of the horn in the front of the loudspeaker.

In the loudspeaker system of the invention the higher acoustic output and increased directional output characters are obtained so that the sound waves radiating from front radiating source and the rear radiating source are summed in a special way.

Because the length of the both sound wave paths from the front loudspeaker to the mouth of the horn and from the rear loudspeaker to the mouth of the horn are same, the both sound waves reach the mouth of the horn in front of the loudspeaker system at the same time and will be summed. Essential in the summing is that because the both sound waves have the same phase they will provide a higher acoustic output and will increase directional output character to the loudspeaker system.

In the loudspeaker system of the invention the length of sound wave path from the front loudspeaker to the mouth of the horn and the sound wave path from the rear loudspeaker to the mouth of the horn are designed to be ¼th of the average wavelength of the bass region. The average wavelength of the bass region is usually in the range of 100 Hz-30 Hz and so the ¼th of the average wavelength is between 0.75 m and 2.5 m. If the enclosure or enclosures in the loudspeaker system are designed so that the length of both sound wave paths are between 1 m and 2 m, the acoustic output between the wavelengths of 75 Hz and 37 Hz in the bass region will be increased.

Essential in the invention is also that the sound wave from the front speaker will travel first through the horn to the mouth of the horn in front of the loudspeaker system and then further to the rear loudspeaker of the loudspeaker system. Because the length of the sound wave path from the front loudspeaker to the mouth of the horn is ¼th of the average wavelength of the bass region and the length of sound wave path from the mouth of the horn to the the rear loudspeaker is also the same ¼th of the average wavelength of the bass region, the total distance for the sound wave from the front loudspeaker to the rear loudspeaker is ½th of the average wavelength.

When the sound wave from the front loudspeaker reaches the rear loudspeaker the sound wave from the front loudspeaker and sound wave from the rear loudspeaker will be summed, Because the sound wave from the front loudspeaker has travelled ½th of the average wavelength of the bass region it is delayed so much that the sound wave from the front loudspeaker and sound wave from the rear loudspeaker are 180° out of phase causing sound cancellation of the rear loudspeaker and increasing the directional radiating character of the front loudspeaker.

To have both sound waves sum correctly In the loudspeaker system of the invention in front of the loudspeaker system it is necessary to have the same 4th order high-pass transfer function for both loudspeaker enclosures, more accurately, a horn-loaded or a vented high-pass enclosure. In the loudspeaker system of the invention the front loudspeaker enclosure is a horn-loaded enclosure and the rear enclosure is a vented high-pass enclosure having at least one vent. Directional character is accomplished by the distance the sound waves have to travel being ¼th of the average wavelength of the bass region, in general 1-2 m. In this case the maximum sound cancellation of the rear loudspeaker happens approximately between 85 Hz and 42 Hz when the front sound wave being travelled ½th of the average wavelength of the bass region to the rear loudspeaker. The sound wave of the rear loudspeaker is having a slightly reduced cancellation of 3-6 dB in the range of 100 Hz-30 Hz depending on the design and the outer dimensions of the enclosure.

Multiple ways of influencing the radiation pattern of the complete sound system by changing the placement of vents and loudspeakers in the rear loudspeaker enclosure are also possible.

Unlike the sound wave produced by a horn-loaded loudspeaker, a vented high-pass enclosure produces a sound wave which is a combination of two frequency parts; a lower part which is radiated through at least one vent and a higher part which is radiated through the loudspeaker. As a result, two variables are possible when comparing the propagation difference of the rear loudspeaker enclosure to the front loudspeaker enclosure.

By using two loudspeakers for the rear loudspeaker enclosure and placing them to the side walls of the loudspeaker enclosure, the propagation difference shortens and raises the cancellation frequency to a higher frequency range. Accordingly, by using two vents for the rear loudspeaker enclosure and placing them into the side walls the propagation difference shortens and raises the lower part of the cancellation frequency to a higher frequency range. More variables such as a combination of the two choices mentioned above are also possible.

As a practical result of the acoustically created propagation delay, both sound sources, the front loudspeaker enclosure and the rear loudspeaker enclosure, can be driven with the same drive signal and using the same amplifier channel making the whole sound system more practical and economical for the user. It is also possible to drive each enclosure separately making it possible to vary the output power of each loudspeaker. Accordingly, using only one amplifier channel but loudspeakers with different nominal impedances can be used to vary the output power of each enclosure.

Multiple loudspeakers can also be used in one or more front loudspeaker enclosures and in one or more rear loudspeaker enclosures. The result of that can create more or less attenuation and less amplifier power may be needed, which adds an economical tool for the user and system designer. For example, almost a double sound pressure level can be achieved to the front side of the loudspeaker system with less attenuation to the rear side of the loudspeaker system by using two horn-loaded front loudspeaker enclosures and one rear loudspeaker enclosure with ¾th total amplifier power.

The invention is hereby illustrated with reference to the drawings. It is noted that in the drawings, which represent different embodiments of the invention, the same reference characters represent the same part of the loudspeaker system of the invention.

FIG. 1 illustrates a loudspeaker system according to the prior art, which is a so-called end-fire configuration with two similar loudspeaker enclosures 10 and 30 driven by two amplifiers 11 and 31 and two amplifier channels. The loudspeaker enclosure 10 has a loudspeaker 20 and the loudspeaker enclosure 30 has a loudspeaker 40. The propagation time difference between the enclosures 10 and 30 is compensated by an electronic delay device 12. The propagation time difference is designed to correspond to ¼ of the average wavelength $\lambda$ produced by the loudspeaker system so that the distance between the loudspeakers 20 and 40 is $\lambda/4$.

Figure 2:
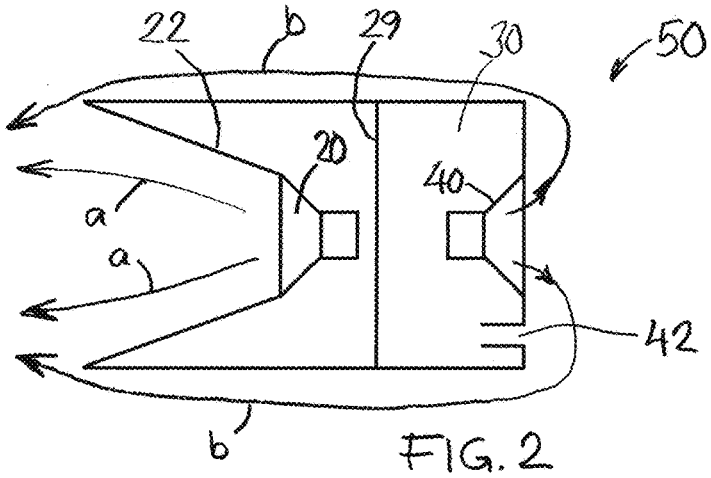

FIG. 2 illustrates a loudspeaker system 50 according to the invention. The loudspeaker system 50 includes a horn-loaded front loudspeaker enclosure 10 and a vented rear loudspeaker enclosure 30. The front loudspeaker enclosure 10 has a loudspeaker 20, a horn part 22, and closed rear wall 29. The rear loudspeaker enclosure 30 has a second loudspeaker 40 and a vent 42. The sound wave path from the front loudspeaker 20 to the mouth of the horn part 22 is (a) and the sound wave path from the second loudspeaker 40 to the mouth of the horn part 22 is (b). According to the invention the length of the sound wave path (a) and the sound wave path (b) are relatively the same.

Figure 3:
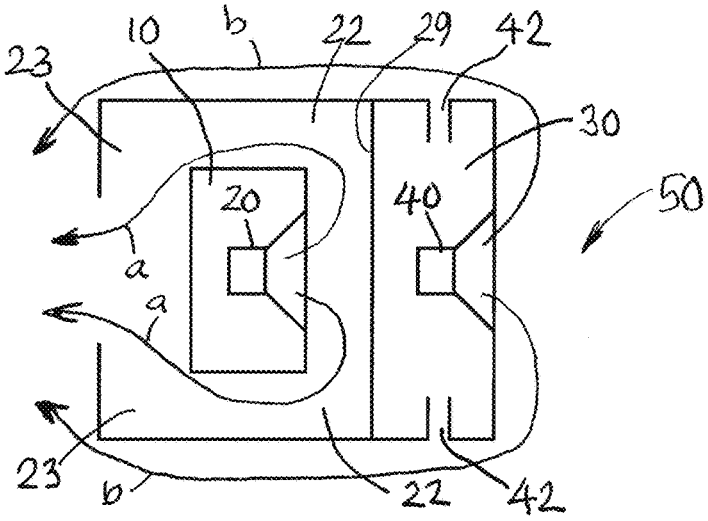

FIG. 3 illustrates a loudspeaker system 50 according to the invention having a horn-loaded front loudspeaker enclosure 10 having a front loudspeaker 20, a horn part 22, a front chamber 23 and a closed rear wall 29. The rear loudspeaker enclosure 30 has a second loudspeaker 40 and a vent 42. According to the invention the horn part 22 is formed as a labyrinth so that the length (a) of the sound wave path from the front loudspeaker 20 to the mouth of the horn part 22 is essentially equal to the length (b) of sound wave path from the second loudspeaker 40 to the mouth of the horn part 22. If the both sound wave paths (a) and (b) are about 2 m, they both equal ¼ of the 8 m sound wave corresponding to the sound frequency of 37 Hz.

In the loudspeaker system of FIG. 3 the sound wave from the front loudspeaker 20 and the sound wave from the second loudspeaker 40 are summed at the mouth of the horn part 22. The summing of the waves obtains a considerably higher acoustic output of the bass frequency area in front of the speaker system because the summed sound waves have the same phase.

In the loudspeaker system of FIG. 3 the sound wave from the front loudspeaker 20 travels first 2 m to the mouth of the horn part 22 and then also further another 2 m to the rear loudspeaker 40. So the sound wave has travelled all together a distance of 4 m, which corresponds ½ of the 8 m sound wave corresponding the sound frequency of 37 Hz. When the sound wave from the front loudspeaker 20 and the sound wave from the rear loudspeaker 40 are summed at the point close to the rear loudspeaker 40 they are 180° out of phase causing sound cancellation of the sound wave of the rear loudspeaker and increasing the directional radiating character of the front loudspeaker in the bass frequency area.

Figure 4:
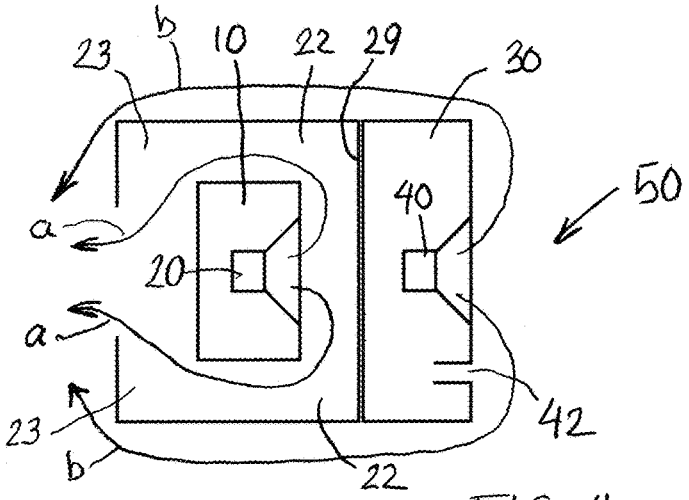

FIG. 4 illustrates a loudspeaker system 50 having a horn-loaded front loudspeaker enclosure 10 and a rear loudspeaker enclosure 30. The enclosures 10 and 30 are divided into two separate units, which can be stacked or placed against each other and locked together to form a combined loudspeaker system 50. However the enclosures 10 and 30 can also be divided into two separate units for easier transporting. The sound wave path from the front loudspeaker 20 to the mouth of the horn part 22 is (a) and the sound wave path from the second loudspeaker 40 to the mouth of the horn part 22 is (b).

Figure 5:
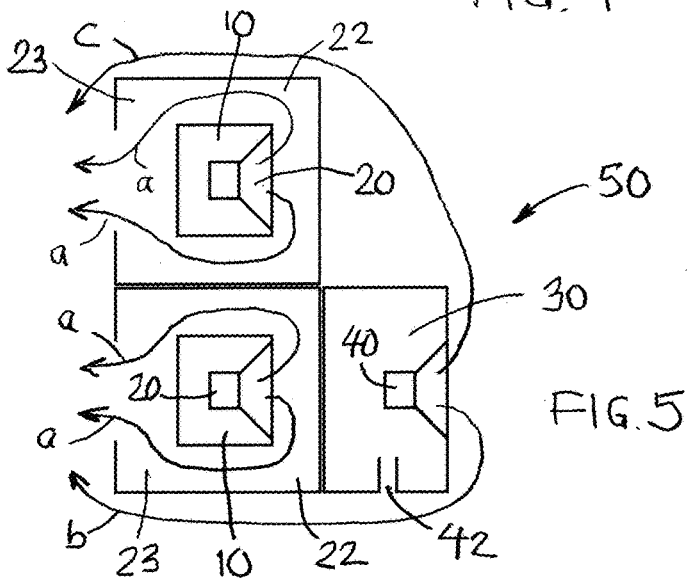

FIG. 5 illustrates a loudspeaker system 50 having two front enclosures 10, 10' and one rear loudspeaker enclosure 30. All the enclosures 10, 10' and 30 are separate units, which can be stacked or placed against each other during the operation of the loudspeaker system 50. After the operation the enclosures 10, 10' and 30 can be divided into separate units for easier transporting. This configuration is useful when less attenuation to the rear side of the loudspeaker system 50 is needed. The sound wave path from the front loudspeakers 20 and 20' to the mouth of the horn parts 22 and 22' are each (a) and the sound wave path from the second loudspeaker 40 to the mouth of the horn parts 22 and 22' are (b) and (c). The loudspeaker system 50 of FIG. 5 may not be as effective as the loudspeaker system 50 of FIG. 4 because the lengths of the sound wave paths (b) and (c) are different.

Figure 6:
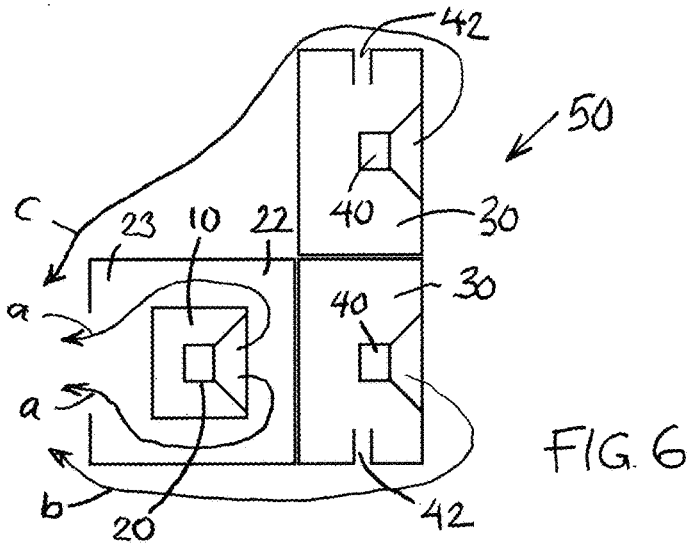

FIG. 6 illustrates a loudspeaker system 50 having having one front enclosure 10 with a front loudspeaker 20 and two rear loudspeaker enclosures 30, 30'. All the enclosures 10, 30 and 30' are separate units, which can be stacked or placed against each other during the operation of the loudspeaker system 50. This configuration is useful when more attenuation to the rear side of the loudspeaker system 50 is needed. Both configurations in FIG. 5 and in FIG. 6 require ¾ of the total amplifier power compared to the configuration illustrated in FIG. 3. It is also possible to tune the enclosures to tune the cancellation frequency due to different propagation difference. The sound wave path from the front loudspeaker 20 to the mouth of the horn part 22 is (a) and the sound wave paths from the rear loudspeakers 40 and 40' to the mouth of the horn part 22 are (b) and (c). The loudspeaker system 50 of FIG. 6 may not be as effective as the loudspeaker system 50 of FIG. 4 because the lengths of the sound wave paths (b) and (c) are different.

Figure 7:
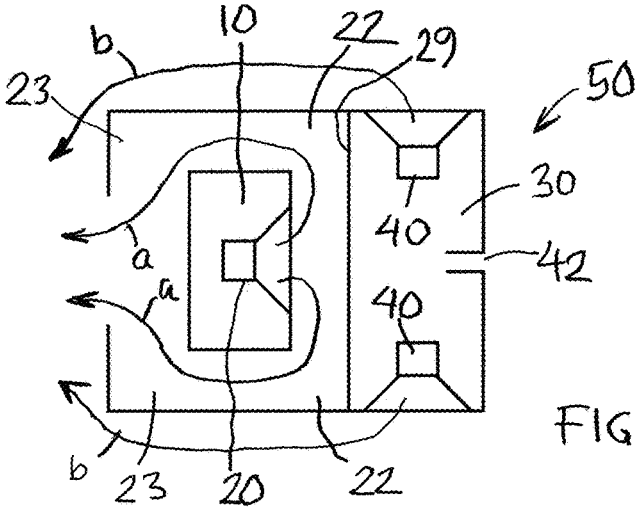

FIG. 7 illustrates a loudspeaker system 50 having having a front enclosure 10 with one front loudspeaker 20 and a rear loudspeaker enclosure 30 having two second loudspeakers 40, 40' and one vent 42. The second loudspeakers 40, 40' are placed into the side walls of the rear loudspeaker enclosure 30 and faced to the sides of the loudspeaker system 50. One vent 42 is placed in the middle of the back wall for maximum distance from the front side of the loudspeaker system 50. The radiation pattern of the complete sound system can have different characteristics when the places of the loudspeakers 40, 40' and vent 42 are changed. The sound wave path from the front loudspeaker 20 to the mouth of the horn part 22 is (a) and the sound wave paths from the rear loudspeakers 40 and 40' to the mouth of the horn part 22 are (b).

Figure 8:
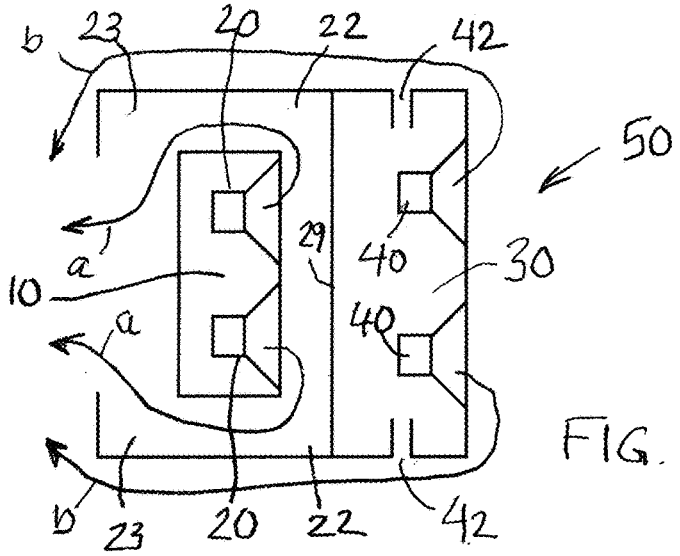

FIG. 8 illustrates a loudspeaker system 50 having having a front enclosure 10 with two front loudspeakers 20, 20' and a rear loudspeaker enclosure 30 having two second loudspeakers 40, 40' and two vents 42, 42'. The vents 42, 42' are placed into both side walls for minimum distance from the front side of the loudspeaker system 50. The sound wave path from the front loudspeakers 20 and 20' to the mouth of the horn part 22 is (a) and the sound wave paths from the rear loudspeakers 40 and 40' to the mouth of the horn part 22 is (b).

Figure 9:
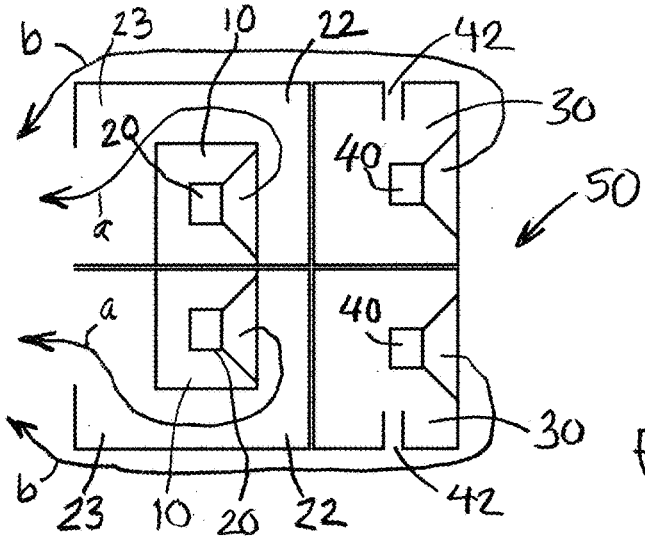

FIG. 9 illustrates a loudspeaker system 50 having having two separate front enclosures 10, 10' and two separate rear loudspeaker enclosures 30, 30'. All the separate enclosures 10, 10' and 30, 30' can be stacked or placed against each other and locked together to form a combined loudspeaker system 50. However all the enclosures 10, 10' and 30, 30' can also be divided into multiple separate units for easier transporting. Any of these enclosures 10, 10' and 30, 30' can also be used as individual bass loudspeaker enclosures in a case when smaller units are needed. The sound wave paths from the front loudspeakers 20 and 20' to the mouth of the horn part 22 is (a) and the sound wave paths from the rear loudspeakers 40 and 40' to the mouth of the horn part 22 is (b).

A loudspeaker system according to the invention comprises a front loudspeaker enclosure having at least one front loudspeaker, the front loudspeaker enclosure having a closed rear wall; and a rear loudspeaker enclosure arranged at the rear wall of the front loudspeaker enclosure, the rear loudspeaker enclosure having at least one second loudspeaker, wherein in the loudspeaker system the front loudspeaker enclosure is in the form of a horn-loaded enclosure and the rear loudspeaker enclosure is a single chamber vented high-pass enclosure.

The impulse and phase responses of the sound source formed by the front loudspeaker enclosure and the rear loudspeaker essentially match. The front loudspeaker and the second loudspeaker are operated by the same drive signal. The vents in the second loudspeaker enclosure can be located in the side walls of the loudspeaker system. The second loudspeakers in the rear loudspeaker enclosure can be located in the side walls of the loudspeaker system.

There can be multiple front loudspeakers in the front loudspeaker enclosure and multiple loudspeakers and/or multiple vents in the rear loudspeaker enclosure. The front loudspeaker enclosure and the rear loudspeaker enclosure can be separate units, which form a loudspeaker system when the enclosures are stacked and/or placed against each other. In the loudspeaker system there are one or more separate front loudspeaker enclosure units and one or more separate rear loudspeaker enclosure units, which are stacked and/or placed against each other to form one unit. The front loudspeaker and the second loudspeaker can also be operated by two drive signals and/or two amplifiers.

REFERENCE NUMERALS

10 Front loudspeaker enclosure
10' Front loudspeaker enclosure
11 Amplifier
12 Delay device
20 Front loudspeaker
20' Front loudspeaker
22 Horn part
23 Front chamber
29 Closed rear wall
30 Rear loudspeaker enclosure
30' Rear loudspeaker enclosure
31 Amplifier
40 Second loudspeaker
40' Second loudspeaker
42 Vent
42' Vent
50 Loudspeaker system

The invention claimed is:

1. A loudspeaker system for obtaining a higher acoustic output and increasing directional output character of the loudspeaker system, the loudspeaker system comprising:

a front loudspeaker enclosure having at least one front loudspeaker, the front loudspeaker enclosure having a closed rear wall; and a rear loudspeaker enclosure arranged at the rear wall of the front loudspeaker enclosure, the rear loudspeaker enclosure having at least one rear loudspeaker, wherein in the loudspeaker system the front loudspeaker enclosure is in the form of a horn-loaded enclosure and the rear loudspeaker enclosure is a single chamber vented high-pass enclosure having at least one vent; and wherein a front radiating sound source provided by the front loudspeaker and horn of the horn-loaded enclosure has a relatively same sound wave path length from the front loudspeaker to the mouth of the horn as a sound wave path length from the rear loudspeaker to the mouth of the horn of a rear radiating sound source provided by the rear loudspeaker such that a sound wave from the front loudspeaker and a sound wave from the rear loudspeaker reach the mouth of the horn in front of the loudspeaker system at the same time and have the same phase and are summed thereby obtaining a considerably higher acoustic output of a bass frequency area in front of the speaker system, and when the sound wave from the front loudspeaker and the sound wave from the rear loudspeaker are summed at a point close to the rear loudspeaker they are 180° out of phase causing sound cancellation of a sound wave of the rear loudspeaker.

2. A loudspeaker system according to claim 1, wherein impulse and phase responses of the front radiating sound source and the rear radiating sound source essentially match.

3. A loudspeaker system according to claim 1, wherein the front loudspeaker and the rear loudspeaker are operated by the same drive signal.

4. A loudspeaker system according to claim 2, wherein the front loudspeaker and the rear loudspeaker are operated by the same drive signal.

5. A loudspeaker system according to claim 1, wherein said at least one vent in the rear loudspeaker enclosure is located in a side wall of the loudspeaker system.

6. A loudspeaker system according to claim 1, wherein said at least one rear loudspeaker in the rear loudspeaker enclosure is located in a side wall of the loudspeaker system.

7. A loudspeaker system according to claim 1, wherein there are multiple front loudspeakers in the front loudspeaker enclosure.

8. A loudspeaker system according to claim 1, wherein there are multiple loudspeakers and/or multiple vents in the rear loudspeaker enclosure.

9. A loudspeaker system according to claim 1, wherein the front loudspeaker enclosure and the rear loudspeaker enclosure are separate units which form a loudspeaker system when the enclosures are stacked and/or placed against each other.

10. A loudspeaker system according to claim 1, wherein in the loudspeaker system there are one or more separate front loudspeaker enclosures and one or more separate rear loudspeaker enclosures, which are stacked and/or placed against each other to form one unit.

11. A loudspeaker system according to claim 1, wherein the front loudspeaker and the rear loudspeaker are operated by two drive signals and/or two amplifiers.

* * * * *